US011629542B2

(12) United States Patent
Lee

(10) Patent No.: US 11,629,542 B2
(45) Date of Patent: Apr. 18, 2023

(54) DOOR HINGE

(71) Applicant: SEO WON KOREA CO., LTD., Gimhae-si (KR)

(72) Inventor: June Young Lee, Busan (KR)

(73) Assignee: SEO WON KOREA CO., LTD.

( * ) Notice: Subject to any disclaimer, the term of this patent is extended or adjusted under 35 U.S.C. 154(b) by 0 days.

(21) Appl. No.: 17/582,119

(22) Filed: Jan. 24, 2022

(65) Prior Publication Data

US 2022/0145683 A1 May 12, 2022

Related U.S. Application Data

(63) Continuation of application No. PCT/KR2020/018009, filed on Dec. 10, 2020.

(30) Foreign Application Priority Data

May 21, 2020 (KR) ..... 10-2020-0060823

(51) Int. Cl.

| | |
|---|---|
| ***E05F 1/12*** | (2006.01) |
| ***E05D 3/18*** | (2006.01) |
| *F24C 15/02* | (2006.01) |

(52) U.S. Cl.

CPC ..... *E05F 1/1253* (2013.01); *E05D 3/18* (2013.01); *E05F 1/1261* (2013.01); *E05Y 2900/20* (2013.01); *E05Y 2900/30* (2013.01); *F24C 15/023* (2013.01)

(58) Field of Classification Search

CPC ..... E05F 1/1253; E05F 1/1261; E05F 1/1269; E05F 1/1276; E05F 1/1041; E05F 1/105; E05F 1/1058; E05F 1/1066; E05F 1/1075; E05D 3/18; F24C 15/023

See application file for complete search history.

(56) References Cited

U.S. PATENT DOCUMENTS 967,230 A * 8/1910 Packer ..... E05D 3/18 126/194
5,535,482 A * 7/1996 Grabber ..... E05D 3/022 16/362
6,928,698 B2 * 8/2005 Chen ..... E05D 3/18 16/335

(Continued)

FOREIGN PATENT DOCUMENTS

DE 2456094 A1 8/1976
EP 0810342 B1 8/2001

(Continued)

OTHER PUBLICATIONS

Extended European Search Report (EP 20936756.4), EPO, dated Oct. 27, 2022.

(Continued)

*Primary Examiner* — Jeffrey O'Brien
(74) *Attorney, Agent, or Firm* — Park & Associates IP Law Office

(57) ABSTRACT

Proposed is a door hinge. More particularly, there is provided a door hinge which is conveniently assembled, has a minimized shape, and above all, enables a closing force to be applied to a door so that when the door is opened, high-temperature heat is inhibited from being released from inside an apparatus on which the door hinge is installed.

3 Claims, 10 Drawing Sheets

(56) References Cited

U.S. PATENT DOCUMENTS

| | | | | |
|---|---|---|---|---|
| 7,243,396 | B2 * | 7/2007 | Vanini | E05F 1/1058 16/286 |
| 7,721,388 | B2 * | 5/2010 | Lee | E05F 1/1276 16/322 |
| 8,266,765 | B2 * | 9/2012 | Donoho | E05F 1/1276 16/286 |
| 8,443,489 | B2 * | 5/2013 | Sir Louis | E05F 3/18 16/306 |
| 8,707,519 | B2 * | 4/2014 | Elkasevic | E05F 3/108 16/286 |
| 8,806,718 | B2 * | 8/2014 | Elkasevic | E05F 1/1261 16/286 |
| 9,080,364 | B2 * | 7/2015 | Vanini | F24C 15/023 |
| 9,121,211 | B1 * | 9/2015 | White | E05F 5/02 |
| 9,316,036 | B2 * | 4/2016 | Collene | E05F 1/1075 |
| 9,353,562 | B2 | 5/2016 | Oshima et al. | |
| 9,625,160 | B2 * | 4/2017 | Xiao | E05F 1/1041 |
| 10,082,298 | B2 * | 9/2018 | White | E05F 3/20 |
| 10,244,920 | B2 * | 4/2019 | Vanini | E05D 3/14 |
| 10,633,904 | B2 * | 4/2020 | Elkasevic | F24C 15/023 |
| 10,890,334 | B2 * | 1/2021 | White | E05D 7/00 |
| 11,168,502 | B2 * | 11/2021 | Oshima | E05F 1/1253 |
| 11,391,078 | B2 * | 7/2022 | Collene | D06F 39/14 |
| 2003/0172920 | A1 * | 9/2003 | Gronbach | E05F 1/1261 126/197 |
| 2008/0078373 | A1 * | 4/2008 | Kim | E05F 1/1276 126/192 |
| 2022/0034140 | A1 * | 2/2022 | Terenzi | E05F 1/1276 |

FOREIGN PATENT DOCUMENTS

| | | | |
|---|---|---|---|
| JP | 6563613 | B2 | 8/2019 |
| KR | 100744968 | B1 | 8/2007 |
| KR | 101104640 | B1 | 1/2012 |
| KR | 1020190076238 | A | 7/2019 |
| KR | 1020190091305 | A | 8/2019 |
| WO | 2013185349 | A1 | 12/2013 |
| WO | 2018216564 | A1 | 11/2018 |

OTHER PUBLICATIONS

Chinese Office Action (CN 202080056698.2), CNIPA, dated Dec. 2, 2022.

Korean Notice of Allowance (KR 10-2020-0060823), KIPO, dated Apr. 12, 2021.

International Search Report (PCT/KR2020/018009), WIPO, dated Mar. 15, 2021.

* cited by examiner

DOOR HINGE

REFERENCE TO RELATED APPLICATIONS

This is a continuation of International Patent Application PCT/KR2020/018009 filed on Dec. 10, 2020, which designates the United States and claims priority of Korean Patent Application No. 10-2020-0060823 filed on May 21, 2020, the entire contents of which are incorporated herein by reference.

FIELD OF THE INVENTION

The present disclosure relates to a door hinge. More particularly, the present disclosure relates to a door hinge which is conveniently assembled, has a minimized shape, and enables a closing force to be applied to a door so that when the door is opened, high-temperature heat is inhibited from being released from inside an apparatus on which the door hinge is installed.

BACKGROUND OF THE INVENTION

Generally apparatuses such as appliances and furniture having a door are provided with a door that is hinge-connected to a body, and the body can be opened and closed by rotating the door.

As apparatuses that are capable of opening and closing a door from an upper end of an apparatus, there are gas oven range and a microwave oven. Such a conventional door hinge is disclosed in Korean Patent No. 10-1104640. FIG. 1 is a view illustrating a door hinge according to a conventional technology.

Referring to FIG. 1, the door hinge according to the conventional technology is provided with two springs. Therefore, there are problems that the material cost of the door hinge is high and the process of the door hinge such as an assembly process is complicated. In addition, since the size of the door hinge is large, there is also a problem that the door hinge cannot be applied to an apparatus that has many spatial limitations.

In addition, there is a need for a technology of a hinge capable of providing convenience during opening and closing a door. There is an increasing need for a technology of a hinge capable of guiding a door to be easily opened and closed. Particularly, there is an increasing need for a technology of a hinge capable of applying a closing force to a door so that high-temperature heat is prevented from being released from inside of an apparatus when the door is opened.

SUMMARY OF THE INVENTION

Accordingly, the present disclosure has been made keeping in mind the above problems occurring in the related art, and an objective of the present disclosure is to provide a door hinge capable of reducing a material cost since the number of components of the door hinge is reduced, thereby also simplifying a manufacturing process of the door hinge.

In addition, another objective of the present disclosure is to provide a door hinge capable of guiding a door to be easily opened and closed. Particularly, still another objective of the present disclosure is to provide a door hinge that enables a door to be opened only when a strong force is applied to the door since a closing force is always applied to the door so that high-temperature heat is prevented from being released from inside an apparatus when the door is opened.

Other objectives and advantages of the present disclosure will be described below. The other objectives and advantages of the present disclosure will be accepted more widely not only by the matters described in the various embodiments and claims but also by the means and combinations that can be generated within the scope that can be easily understood, from the embodiments of the present disclosure.

In order to achieve the above objectives of the present disclosure, there is provided a door hinge including: a body frame mounted to a body of an apparatus having a door; a door frame mounted to the door and configured to be rotated by being connected to the body frame; an internal frame provided inside the door frame, the internal frame including a pin provided on a first side thereof to cross a front surface of a first side of the door frame, and the internal frame having a second side thereof connected to the body frame via a link shaft such that the internal frame is configured to be rectilinearly moved to a second side direction when the door frame is rotated; and a rod frame provided inside the internal frame, the rod frame including a rod portion to which an elastic member is fitted, a body portion having a first side thereof connected to the rod portion and provided to prevent the elastic member from being separated, and a roller provided on a second side of the body portion and configured to be rotated in contact with the body frame when the door frame is rotated, wherein when the door frame is rotated, the internal frame is rectilinearly moved by a rotation movement of the link shaft, and the elastic member is pressed by the pin of the internal frame, and a closing force is always applied to the door frame by both an elasticity of the elastic member and a force that the roller contacts the body frame.

In addition, according to an exemplary embodiment of the present disclosure, a portion of the body frame in contact with the roller may include a curved portion that protrudes outward.

In addition, according to an exemplary embodiment of the present disclosure, the closing force may be applied to the door frame until the roller is in contact with a maximum curvature point of the curved portion.

In addition, the door frame may further include: a pin hole which is provided in the first side of the door frame and into which the pin is fitted, the pin hole being configured such that the pin is rectilinearly moved; and a link hole which is provided in a second side of the door frame and into which the link shaft is fitted, the link hole being formed in a curved line shape such that the link shaft is rotated.

As described above, according to the present disclosure, the following advantages may be realized.

For example, the material cost can be reduced by using only one spring in a component having a structure that conventionally requires two springs, so that the manufacturing process also can be simplified.

In addition, since the number of components is reduced, there is an effect that the length of the door hinge is minimized. That is, there are many spatial limitations in the door hinge, but the length of the door hinge is minimized, so that there is an effect that the door hinge can be applied to various apparatuses.

In addition, there is an effect that the door can be guided to be easily opened and closed. Particularly, since the closing force is always applied to the door so that the high-temperature heat is prevented from being released from inside the apparatus when the door is opened, the door is configured such that the door is opened only when a strong force is applied to the door, so that there is an effect that is capable of preparing for a problem such as the high-temperature heat is released or the internal explosion occurs.

The effect of the present disclosure will be accepted more widely not only by the matters described in the embodiment and claims, but also by the effects that can be generated within the scope that can be easily understood and the possibility of the advantages that contribute to the development of the industry.

DETAILED DESCRIPTION OF THE INVENTION

Hereinafter, an exemplary embodiment of the present disclosure will be described in detail with reference to the accompanying drawings. Advantages and features of the present disclosure and a method for achieving them will be apparent with reference to embodiments described below together with the attached drawings. In addition, the terms used herein are only for explaining embodiments and are not to be understood as limiting the inventive concept. The terms in a singular form in the specification also include plural forms unless otherwise specified, and the words indicating the direction in the description are for aiding understanding of the description and may be changed according to the viewpoint.

Figure 1:
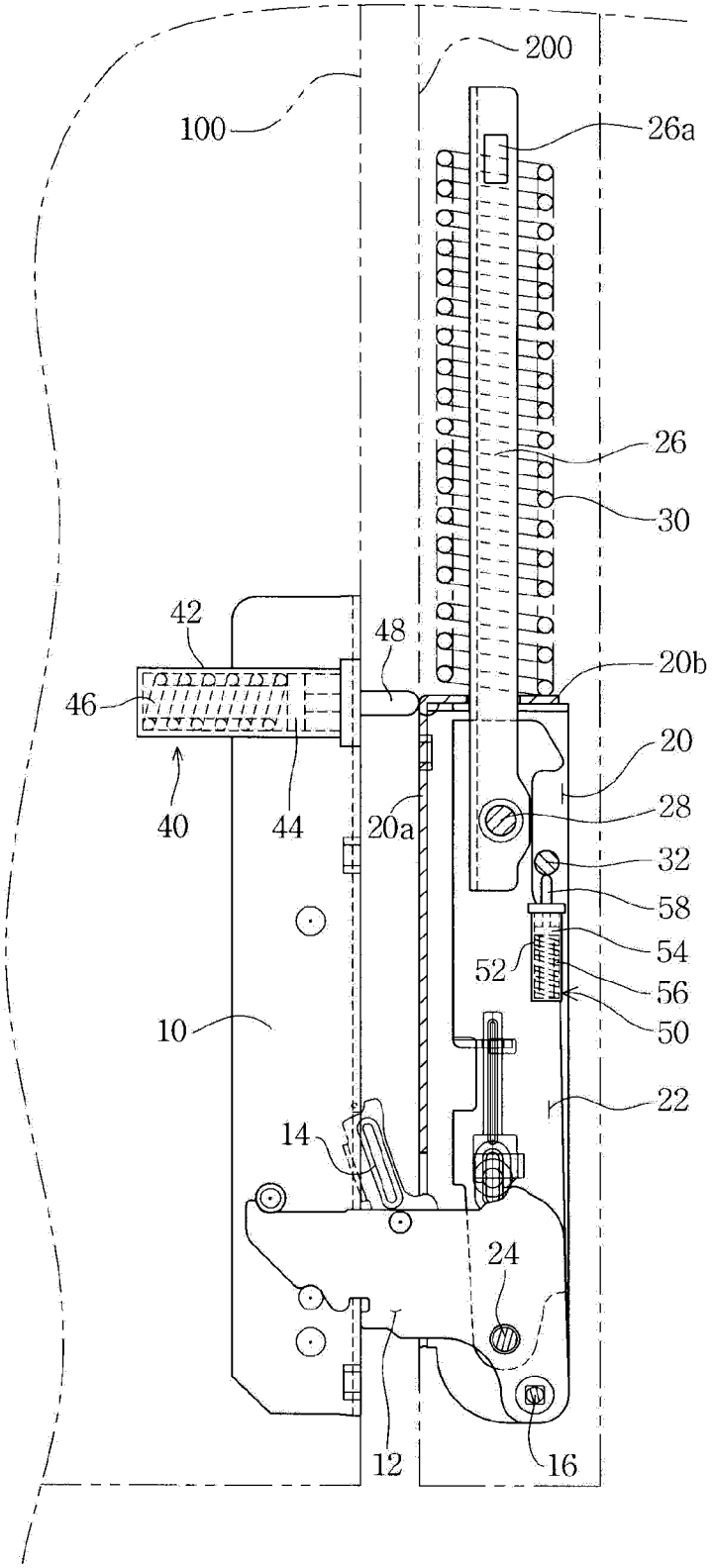
FIG. 1 (PRIOR ART)
FIG. 1 is a view illustrating a door hinge according to a conventional technology.
Figure 2A:
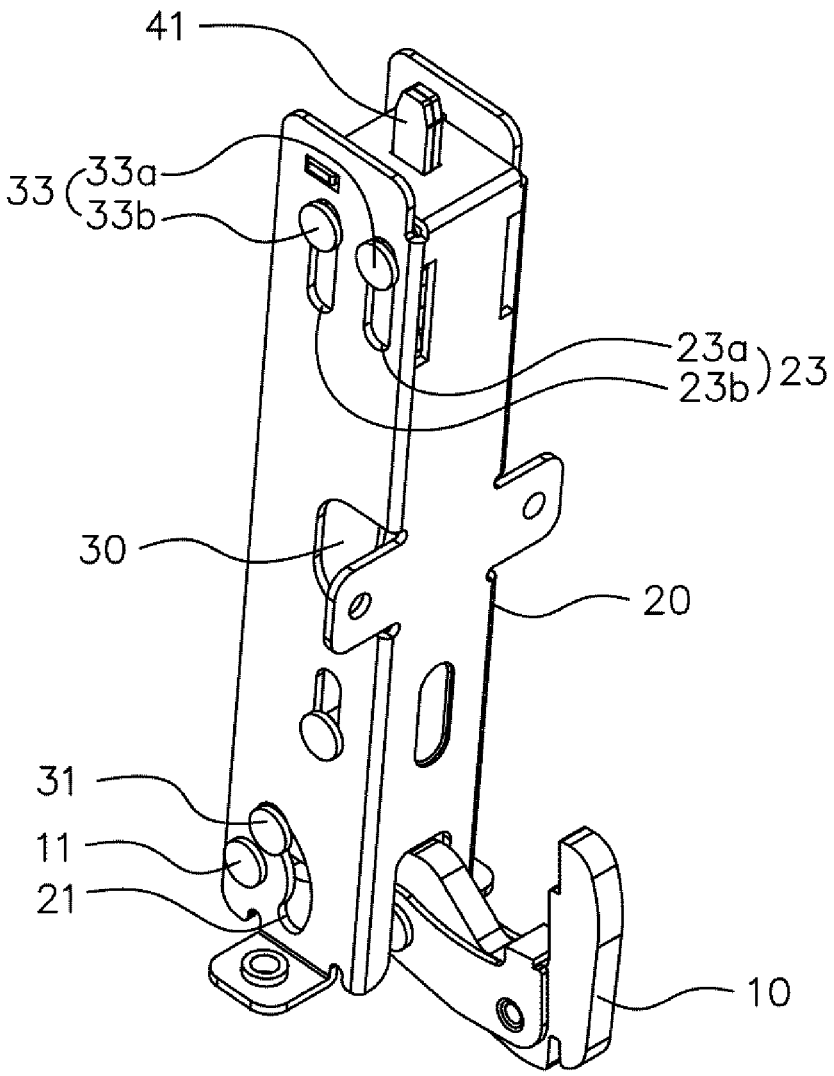
FIG. 2A is a perspective view illustrating a door hinge according to the present disclosure.
Figure 2B:
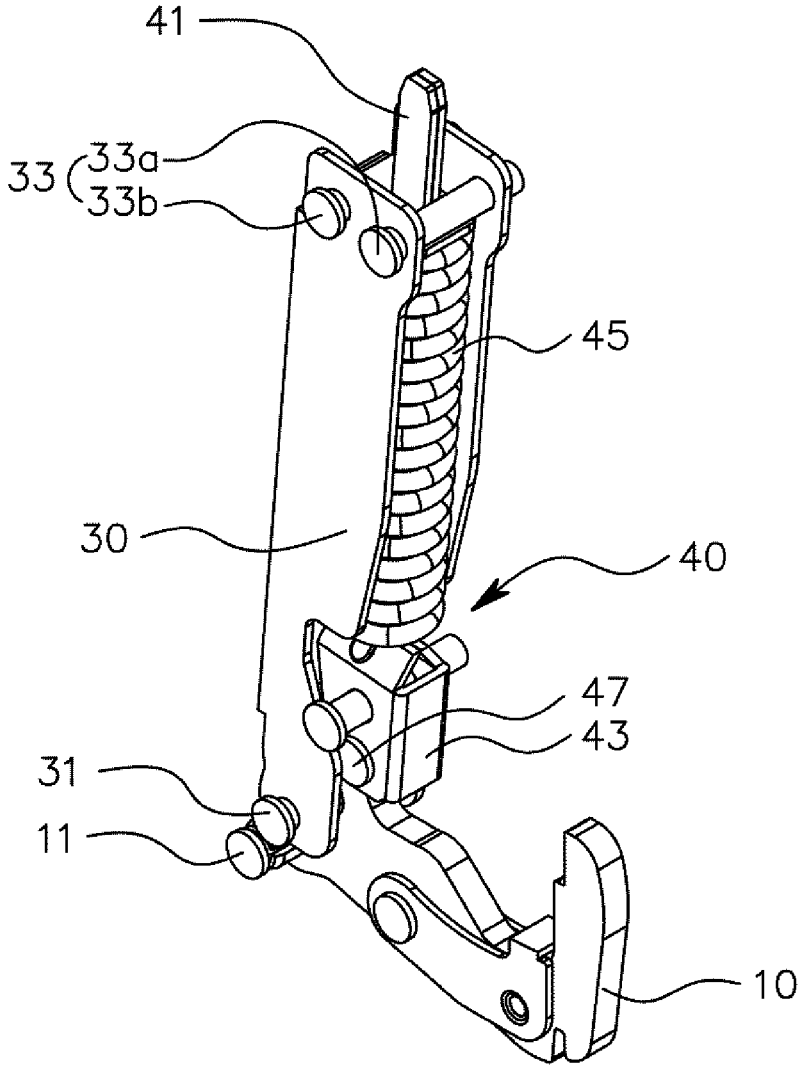
FIG. 2B is a perspective view illustrating the door hinge according to the present disclosure, from which a door frame is omitted.
Figure 3:
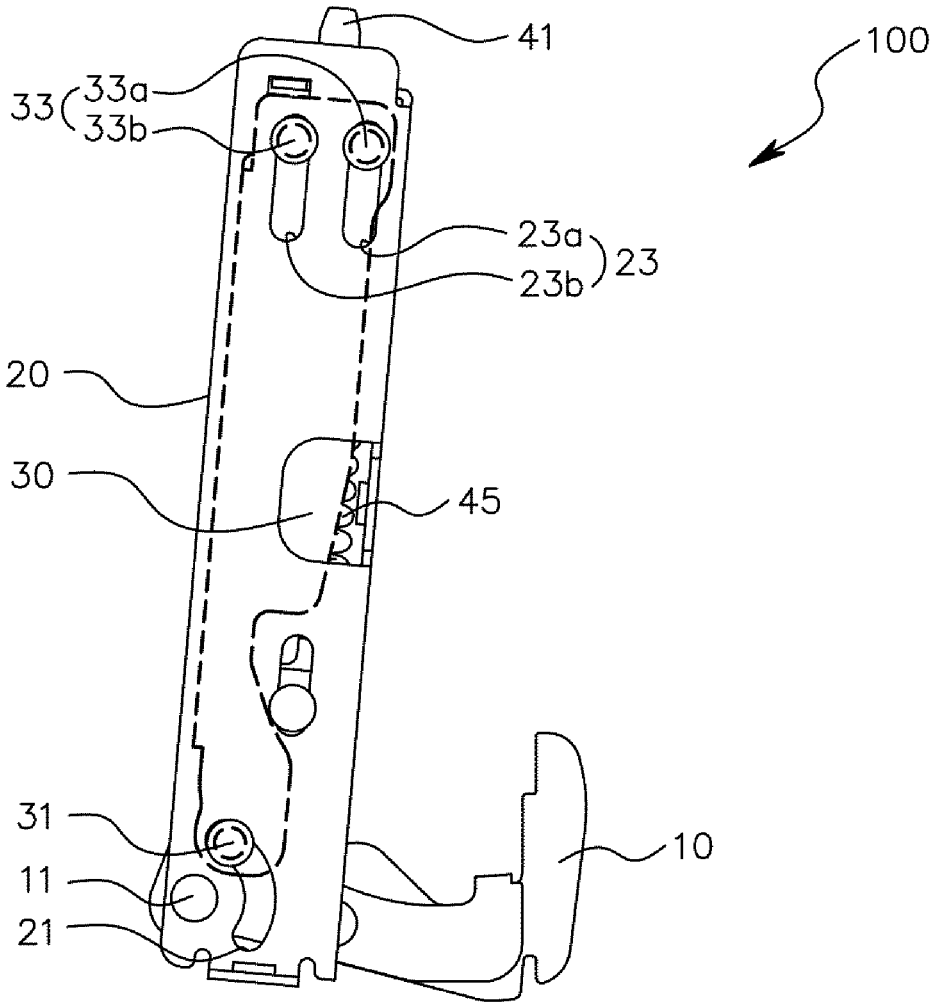
FIG. 3 is a plan view illustrating a closed state of the door hinge according to the present disclosure.
Figure 4:
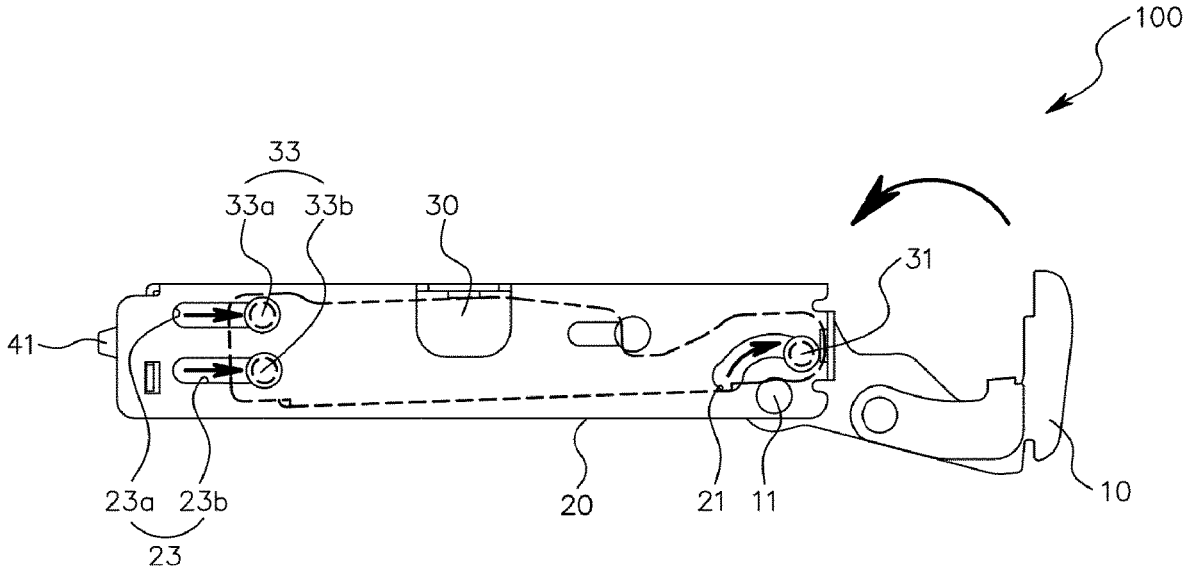
FIG. 4 is a plan view illustrating an opened state of the door hinge according to the present disclosure.

Hereinafter, a door hinge according to an exemplary embodiment of the present disclosure will be described in detail with reference to accompanying drawings. FIG. 2A is a perspective view illustrating a door hinge according to the present disclosure. FIG. 2B is a perspective view illustrating the door hinge according to the present disclosure, from which a door frame is omitted. FIG. 3 is a plan view illustrating a closed state of the door hinge according to the present disclosure. FIG. 4 is a plan view illustrating an opened state of the door hinge according to the present disclosure.

Referring to FIGS. 2A to 4, a door hinge 100 according to the present disclosure includes a body frame 10, a door frame 20, an internal frame 30, and a rod frame 40.

The body frame 10 is mounted to a body of an apparatus having a door. The body frame 10 is formed in an "L" shape. Further, a first side of the body frame 10 is fixed to and coupled to the body, and a second side of the body frame 10 is connected to the door frame 20 that will be described later. The body frame 10 includes a hinge shaft 11 and a curved portion 15.

The hinge shaft 11 connects the body frame 10 to the door frame 20 that will be described later. Further, when the door is opened, the hinge shaft 11 enables the door frame 20 to be rotated from the body frame 10. The hinge shaft 11 is fixed to and connected to the body frame 10, and the door frame 20 is configured to be rotated via the hinge shaft 11.

In the body frame 10, the curved portion 15 is provided on a portion in contact with a roller 47 of the rod frame 40 that will be described later. That is, the curved portion 15 is provided on the second side of the body frame 10. The curved portion 15 protrudes outward. By the curved portion 15 and a driving of the roller 47, a closing force may be always applied to the door. This will be described later in detail with reference to FIGS. 5A to 5E.

The door frame 20 is mounted to the door. The door frame 20 includes a pin hole such as two pin holes 23*a* and 23*b* formed in a first side of the door frame 20, and includes a link hole 21 formed in a second side of the door frame 20.

The link hole 21 of the door frame 20 is a portion into which a link shaft 31 of the internal frame 30 that will be described later is fitted. The link hole 21 is formed in a curved line shape, and is formed around the hinge shaft 11. Further, the link hole 21 enables the door frame 20 to be easily rotated around the link shaft 31.

A first pin hole 23*a* and a second pin hole 23*b* are provided in the first side of the door frame 20. The first and second pin holes 23*a* and 23*b* are portions into which a pin, such as a first pin 33*a* and a second pin 33*b*, of the internal frame that will be described later is fitted. The first and second pin holes 23*a* and 23*b* enable the first and second pins 33*a* and 33*b* to be rectilinearly moved. In the embodiment, it is described that the number of pin holes 23 and the number of pins 33 are two, but are not limited thereto.

The internal frame 30 is provided inside the door frame 20, and is connected to the body frame 10. The internal frame 30 includes a pin, such as two pins 33*a* and 33*b*, formed on a first side of the internal frame 30, and includes the link shaft 31 formed on a second side of the internal frame 30.

The second side of the internal frame 30 is connected to the body frame 10 via the link shaft 31. The link shaft 31 is fitted into the link hole 21 that is formed in the door frame 20. When the door is opened, the door frame 20 is rotated around the link shaft 31 of the internal frame 30 along the link hole 21. Here, since the body frame 10 is fixed to and coupled to the apparatus, the link shaft 31 is not moved, but the door frame 20 in which the link hole 21 is formed is moved around the link shaft 31 that is fixed to and mounted to the internal frame 30.

In the first side of the internal frame 30, two pins 33*a* and 33*b* are provided to cross a front surface of the first side of the door frame 20. The first and second pins 33*a* and 33*b* are provided to cross the front surface of the door frame 20 such that an elastic member 45 of the rod frame 40 is prevented from being separated, and enable the elastic member 45 to be contracted when the door is opened.

When the door frame 20 is rotated by opening the door, the internal frame 30 is rectilinearly moved toward the body frame 10 in a second side direction, that is, as illustrated by the rectilinear arrows in FIG. 4. At this time, the first and second pins 33*a* and 33*b* of the internal frame 30 are also rectilinearly moved along the first and second pin holes 23*a* and 23*b*, as illustrated by the rectilinear arrows in FIG. 4.

As such, from the closed state of the door as illustrated in FIGS. 2A to 3, when the door is open as illustrated in FIG. 4, the door frame 20 is rotated around the link shaft 31 of the internal frame 30 along the link hole 21. Further, the first and second pins 33*a* and 33*b* of the internal frame 30 are rectilinearly moved along the first and second pin holes 23*a* and 23*b*.

The rod frame 40 is provided inside the internal frame 30. The rod frame 40 includes a rod portion 41, a body portion 43, the elastic member 45, and the roller 47.

The rod portion 41 is formed in a rod shape, and is provided on a first side of the rod frame 40. Further, the rod portion 41 may be fitted such that a first end of the rod portion 41 protrudes with respect to the front surface of the door frame 20. That is, the rod portion 41 protrudes with respect to a front surface of the internal frame 30, and protrudes with respect to the front surface of the door frame 20. The elastic member 45 is fitted to the rod portion 41. By the rod portion 41 provided inside the internal frame 30, the elastic member 45 fitted to the rod portion 41 is not separated to a first side of the rod portion 41.

A first side of the body portion 43 is connected to a second side of the rod portion 41. A diameter of the body portion 43 is larger than a diameter of the rod portion 41. Therefore, the elastic member 45 fitted to the rod portion 41 is not separated to a second side of the rod portion 41.

The elastic member 45 is fitted to the rod portion 41. By the internal frame 30, a first side of the elastic member 45 is not separated from the rod portion 41. Further, by the body portion 43, a second side of the elastic member 45 is not separated from the rod portion 41. When the door is rotated, the internal frame 30 and the first and second pins 33*a* and 33*b* are rectilinearly moved by the rotation of the door frame 20, and the elastic member 45 is contracted.

The roller 47 is provided on a second side of the body portion 43 of the rod frame 40. The roller 47 is in contact with the body frame 10 such as the curved portion 15 of the body frame 10. That is, when the door frame 20 is rotated by the rotation of the door, the roller 47 is rotated in contact with the curved portion 15 of the body frame 10. The roller 47 can be rotated only when a strong force is applied up to the maximum curvature point of the curved portion 15 of the body frame 10. Due to the shape of the curved portion 15 that protrudes outward and an elastic force of the elastic member 45, for example, a strong closing force is generated by a tensile force, so that the roller 47 is rotated when a strong force for opening the door is applied.

Hereinafter, a driving of the door hinge 100 by the rotation of the door according to the embodiment will be described in detail. FIGS. 5A to 5E are internal structure views illustrating an opening/closing state of the door hinge according to the present disclosure.

Figure 5A:
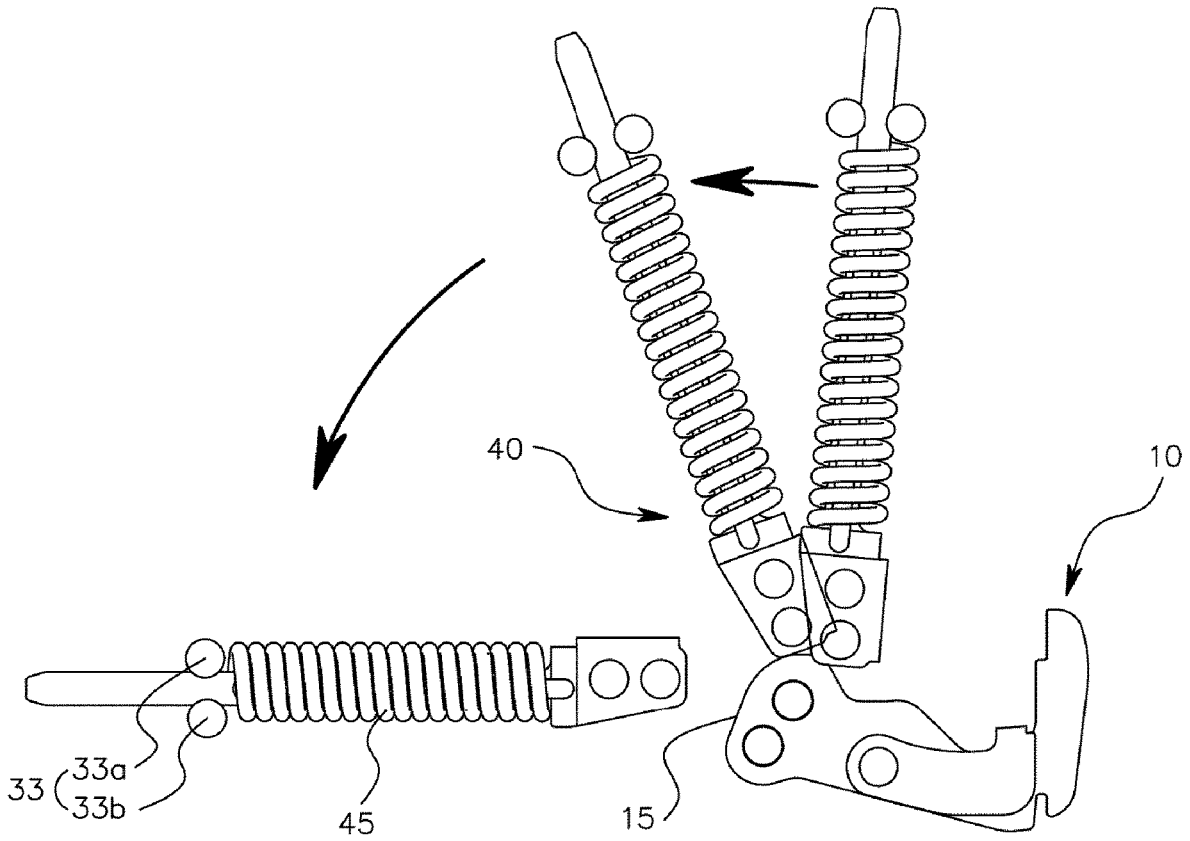
FIGS. 5A to 5E are internal structure views illustrating an opening/closing state of the door hinge according to the present disclosure.

FIG. 5A is a view illustrating an internal structure of the door hinge, such as structures of the body frame 10 and the rod frame 40, when the door is opened. From the closed state of the door as illustrated in FIGS. 2A to 3, when the door is opened, the internal frame 30 and the rod frame 40 that are provided inside the door frame 20 are moved. Further, the rod frame 40 is moved as illustrated by the arrows in FIG. 5A. That is, the first and second pins 33*a* and 33*b* are rectilinearly moved, the elastic member 45 is contracted, and the body portion 43 of the rod frame 40 is rectilinearly moved. Here, the rectilinear movement of the first and second pins 33*a* and 33*b* is the rectilinear movement of the internal frame 30 to which the pins 33 are fixed and coupled.

Figure 5B:
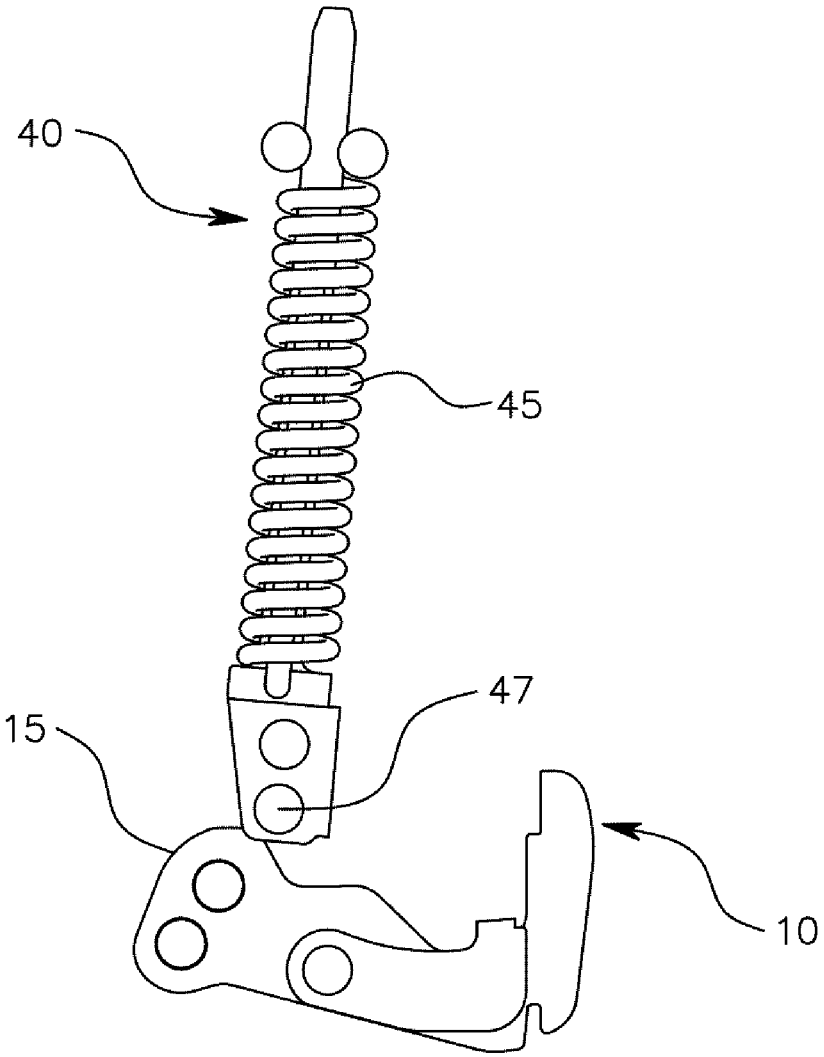

FIG. 5B is a view illustrating the closed state of the door. That is, FIG. 5B illustrates the internal structure in which the door is in the closed state as illustrated in FIGS. 2A to 3. When the door is closed, the rod frame 40 is provided in a state in which the roller 47 is in contact with the curved portion 15 of the body frame 10. The elastic member 45 is in a state of being tensioned within the rod frame 40.

Figure 5C:
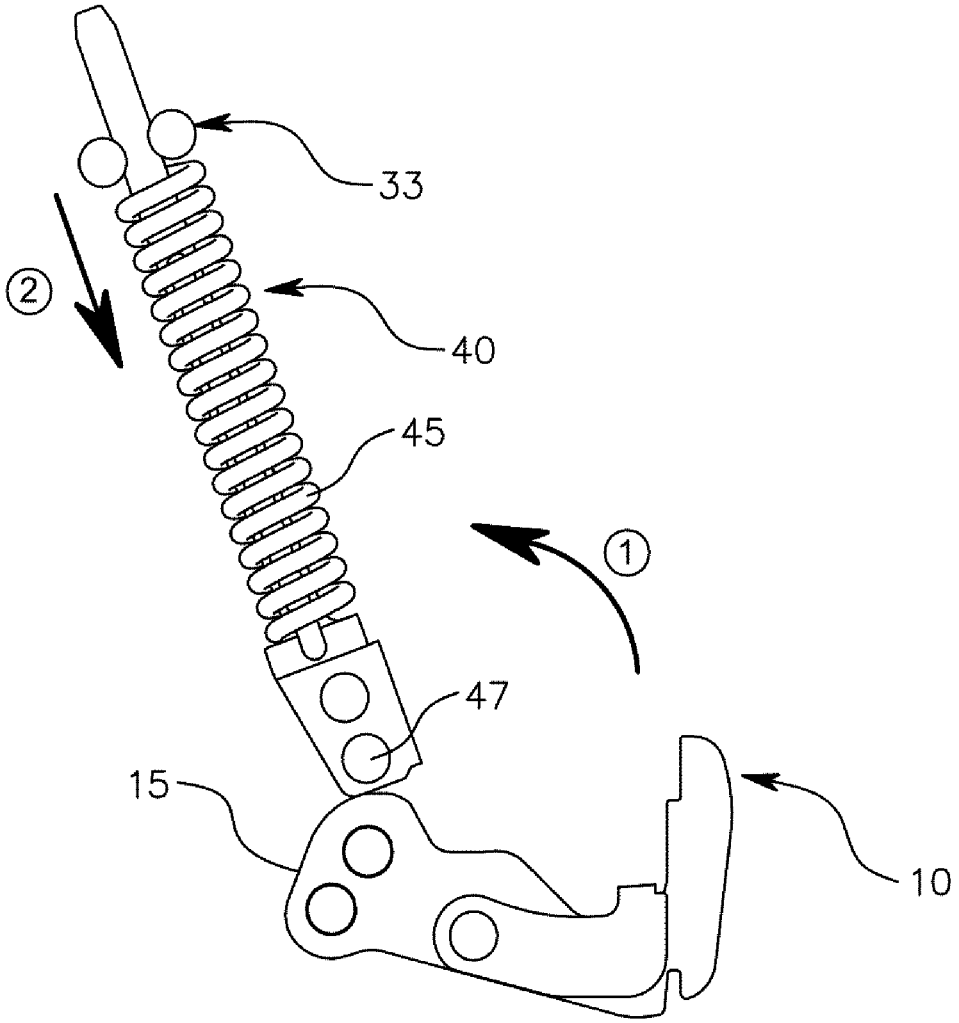
Figure 5D:
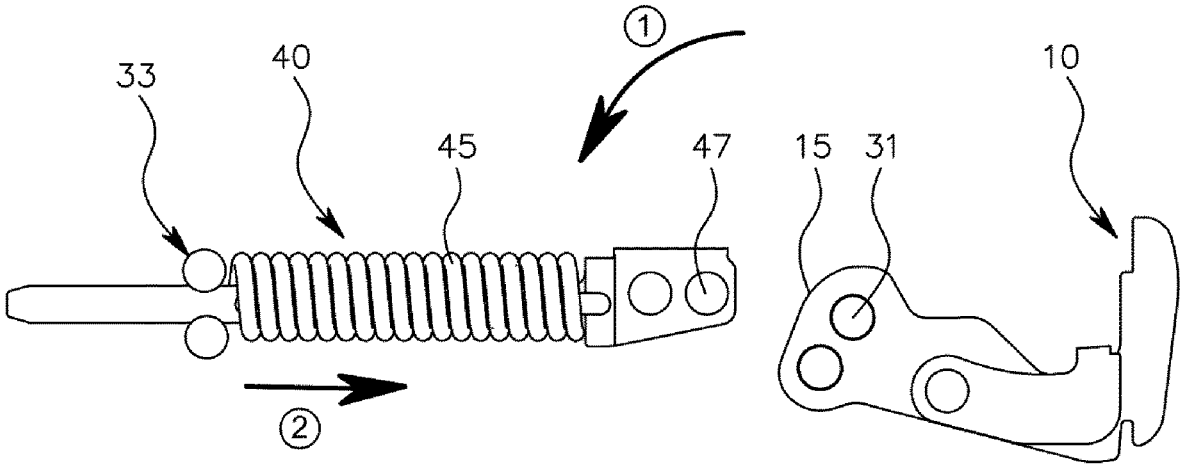
Figure 5E:
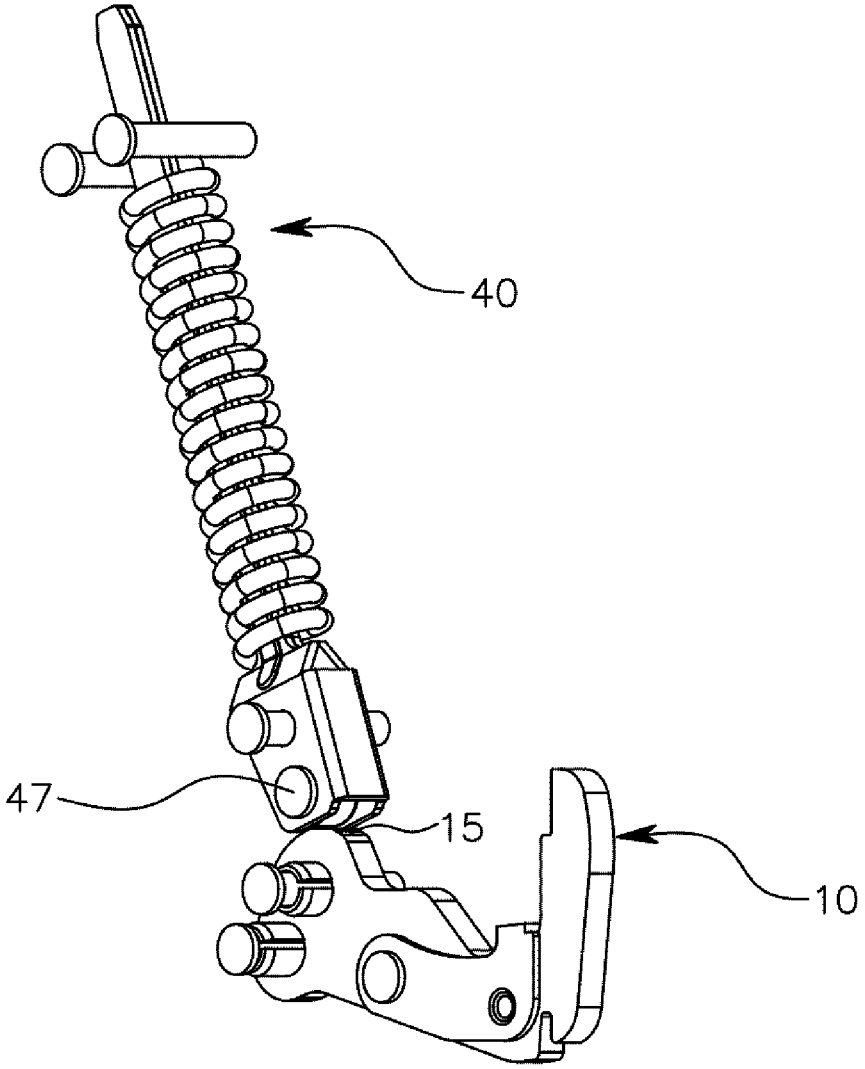

FIGS. 5C and 5E are views illustrating a state in which the door is being opened. When the door is being opened, the rod frame 40 is moved as illustrated by the arrow 1, and the pins 33 and the elastic member 45 are rectilinearly moved as illustrated by the arrow 2. At this time, the roller 47 is in contact with the curved portion 15 of the body frame 10, and a user should apply a force up to the maximum curvature point of the curved portion 15. That is, due to the tensile force of the elastic member 45 and the curvature of the curved portion 15, the user should apply the force at least a predetermined level such that the roller 47 passes the maximum curvature point of the curved portion 15 in order for the door to be opened. Since the closing force is always applied to the door, the user should apply a strong force to open the door. Therefore, there is an effect that is capable of preparing for a problem such as high-temperature heat is released or an internal explosion occurs.

FIG. 5D is a view illustrating a fully opened state of the door. That is, FIG. 5D illustrates the internal structure in which the door is in the opened state as illustrated in FIG. 4.

When the door is fully opened, the rod frame 40 is opened as illustrated by the arrow 1 in FIG. 5D, and the pins 33 and the elastic member 45 are rectilinearly moved as much as possible as illustrated by the arrow 2 in FIG. 5D. At this time, as illustrated in FIG. 4, since the internal frame 30 is rectilinearly moved, the door frame 20 is rotated around the link shaft 31 along the link hole, and the roller 47 is spaced apart from the curved portion 15 and is not in contact with the curved portion 15.

As such, in the door hinge 100 according to the present disclosure, when the door is opened, the closing force is applied to the door until the roller 47 reaches the maximum curvature point of the curved portion 15, so that the user should apply a strong force to open the door. When the roller 47 is beyond the maximum curvature point of the curved portion 15, the door is slowly opened by weight of the door. Accordingly, there is an effect that the door is guided to be easily opened and closed. Particularly, since the closing force is always applied to the door so that the high-temperature heat is prevented from being released from inside of the apparatus when the door is opened, the door is configured such that the door is opened only when a strong force is applied to the door, so that there is an effect that is capable of preparing for the problem such as the high-temperature heat is released or the internal explosion occurs.

Although the embodiments of the present disclosure have been disclosed for illustrative purposes, those skilled in the art will appreciate that various modifications, additions and substitutions are possible, without departing from the scope and spirit of the present disclosure. As described above, the embodiments and the accompanying drawings disclosed in the present disclosure are provided for describing the present disclosure and are not intended to limit the technical ideas of the present disclosure. The technical ideas of the present disclosure are not limited to the embodiments and the drawings. The scope of the present disclosure should be construed as being covered by the scope of the appended claims, and all technical ideas falling within the scope of the claims should be construed as being included in the scope of the present disclosure.

What is claimed is:

1. A door hinge comprising:

a body frame mounted to a body of an apparatus having a door;

a door frame mounted to the door and configured to be rotated by being connected to the body frame;

an internal frame provided inside the door frame, the internal frame comprising a pin provided on a first side thereof to cross a front surface of a first side of the door frame, and the internal frame having a second side thereof connected to the body frame via a link shaft such that the internal frame is configured to be rectilinearly moved to a second side direction when the door frame is rotated; and a rod frame provided inside the internal frame, the rod frame comprising a rod portion to which an elastic member is fitted, a body portion having a first side thereof connected to the rod portion and provided to prevent the elastic member from being separated, and a roller provided on a second side of the body portion and configured to be rotated in contact with the body frame when the door frame is rotated, wherein when the door frame is rotated, the internal frame is rectilinearly moved by a rotation movement of the link shaft, and the elastic member is pressed by the pin of the internal frame, and a closing force is applied to the door frame by both an elasticity of the elastic member and a force that the roller contacts the body frame;

wherein the door frame further comprises:

a pin hole which is provided in the first side of the door frame and into which the pin is fitted, the pin hole being configured such that the pin is rectilinearly moved; and a link hole which is provided in a second side of the door frame and into which the link shaft is fitted, the link hole being formed in a curved line shape such that the link shaft is rotated.

2. The door hinge of claim 1, wherein a portion of the body frame in contact with the roller comprises a curved portion that protrudes outward.

3. The door hinge of claim 2, wherein the closing force is applied to the door frame until the roller is in contact with a maximum curvature point of the curved portion.

* * * * *